US005832846A

United States Patent [19]

Mankowski et al.

[11] Patent Number: 5,832,846

[45] Date of Patent: Nov. 10, 1998

[54] WATER INJECTION $NO_X$ CONTROL PROCESS AND APPARATUS FOR CYCLONE BOILERS

[75] Inventors: Louis J. Mankowski, Linden; James J. McCauley, Parsippany; Victor M. Lucariello, Lebanon; Thomas J. Scott, Farmingdale, all of N.J.

[73] Assignee: Public Service Electric And Gas Corporation, Newark, N.J.

[21] Appl. No.: 584,285

[22] Filed: Jan. 11, 1996

[51] Int. Cl.[6] ..... F23J 11/00; F23B 7/00

[52] U.S. Cl. ..... 110/345; 110/234; 431/4

[58] Field of Search ..... 110/234, 264, 110/265, 266, 345, 188; 122/367.1; 60/39.05; 431/8, 10, 4

[56] References Cited

U.S. PATENT DOCUMENTS

| | | | |
|---|---|---|---|
| 3,672,808 | 6/1972 | Miyazaki | 431/2 |
| 3,748,080 | 7/1973 | Dunn | 431/4 |
| 3,809,523 | 5/1974 | Varekamp | 431/4 |
| 3,850,569 | 11/1974 | Alquist | 431/4 |
| 3,860,384 | 1/1975 | Vulliet et al. | 431/4 |
| 3,921,389 | 11/1975 | Kawaguchi | 60/39.05 |
| 4,089,639 | 5/1978 | Reed et al. | 431/211 |
| 4,127,379 | 11/1978 | Grove | 431/4 |
| 4,152,108 | 5/1979 | Reed et al. | 431/188 |
| 4,394,118 | 7/1983 | Martin | 431/4 |
| 4,505,665 | 3/1985 | Mansour | 431/10 |
| 4,533,314 | 8/1985 | Herberling | 431/4 |
| 4,618,323 | 10/1986 | Mansour | 431/177 |
| 4,726,302 | 2/1988 | Hein et al. | 110/345 |
| 4,768,949 | 9/1988 | Goodfellow | 432/214 |
| 5,018,458 | 5/1991 | McIntyre et al. | 110/346 |
| 5,029,557 | 7/1991 | Korenberg | 122/149 |
| 5,224,851 | 7/1993 | Johnson | 431/115 |

OTHER PUBLICATIONS

"Low–Cost Techniques Reduce Boiler $NO_x$", Joseph Colannino, Chemical Engineering, Feb. 1993, pp. 100–106.

*Primary Examiner*—Ira S. Lazarus
*Assistant Examiner*—Ljiljana V. Ciric
*Attorney, Agent, or Firm*—Dowell & Dowell, P.C.

[57] ABSTRACT

A process and apparatus for limiting the production of nitrogen oxides ($NO_x$) during the combustion of a fossil fuel (e.g. natural gas, fuel oil and coal) in a cyclone type boiler includes the injection of water into the secondary air supply. The water is quickly vaporized into steam as the temperature rises, simultaneously cooling the surrounding air predominately as a result of the latent heat of vaporization, thus reducing the quantity of heat contained within the combustion air delivered to the flame. To avoid quenching combustion, substantially all of the water is vaporized into steam prior to exiting the cyclone section. For natural gas and fuel oil, preferably about 2.5 to 10.0 gallons of water are injected per 100 lbs of fuel. Water is injected through existing ports originally provided in cyclone boilers either for use as secondary air calibration ports or as oil deslagging system ports. A plurality of V-jet type spray nozzles are utilized to achieve a uniform dispersion of water in the combustion air and to keep the droplet size small. The location of the nozzles is selected to maximize heat extraction from the flame, while not quenching the flame. A process control system may be utilized to inject a quantity of water proportional to the quantity of fuel fired, for single fuel and multiple fuel (e.g. both oil fuel and gas fuel) cyclone boiler fuel systems.

23 Claims, 6 Drawing Sheets

WATER INJECTION $NO_X$ CONTROL PROCESS AND APPARATUS FOR CYCLONE BOILERS

BACKGROUND OF THE INVENTION

1. Field of the Invention

The invention relates generally to nitrogen oxides emissions control, and, more particularly, to a water injection process and apparatus for limiting the amount of nitrogen oxides formed during fossil fuel combustion in a cyclone boiler unit.

2. History of the Related Art

The combustion of fossil fuels (e.g. coal) in power plants to produce power also generates undesirable nitrogen oxides ($NO_x$), usually in a combination of nitric oxide (NO) and nitrogen dioxide ($NO_2$). Numerous methods have been attempted to lessen the amount of $NO_x$ produced. A large percentage of the $NO_x$ formation is attributable to the high-temperature reaction of nitrogen and oxygen in the air used for combustion.

The concept of injecting water directly into the combustion flame zone to lower combustion temperatures and reduce $NO_x$ emissions was one of the first control concepts commercially deployed. In the early phases of $NO_x$ control technology for combustion turbines (CTs), water or steam was injected to lower the mean flame temperature at which combustion occurred. For fuels containing insignificant amounts of fuel bound nitrogen, such as those fuels conventionally utilized in CTs, the formation of $NO_x$ is primarily driven by thermal fixation of atmospheric nitrogen and oxygen. Accordingly, the concept of limiting peak combustion temperatures was recognized as an effective step in minimizing $NO_x$ for CTs. By controlling the peak flame temperatures at which combustion occurs, the production rate of $NO_x$ from thermal sources is minimized. There are limits to the use of this technology, as a minimum residence time at sufficient combustion temperatures must be observed to obtain acceptable fuel utilization. Also, this technique does not significantly influence the contribution of fuel-bound nitrogen to $NO_x$, which for coal and heavy fuel oils can be a significant component, depending on the boiler design.

The introduction of water into the combustor section of a combustion turbine also introduces undesirable metal impurities from dissolved or suspended solids (e.g. Ca, Mg, Fe, Cu, etc.) in the make-up water that is vaporized, and eventually condenses on surfaces that demand high purity for reliable operation, such as turbine blades. These deposits cause operating problems, eventually requiring special pretreatment of water prior to injection. To avoid these problems, and the loss in thermal efficiency due to the latent heat for moisture, so-called "dry" $NO_x$ control techniques have been developed for CTs. These techniques control fuel/air mixing to manipulate stoichiometry, and to minimize combustion temperatures, and are preferred to water injection for many CTs.

The class of utility boilers known as cyclone boilers, constructed for generating steam for power production, have become a commonly used utility boiler in the United States. The cyclone boilers, originally introduced into the U.S. utility industry in the 1950s, were initially intended to provide low cost steam and power production by utilizing coals with specific ash characteristics that allowed ash removal in a liquid, molten state. Specifically, these boilers were constructed to transform hot ash particles into a molten, flowing medium that could be removed within the furnace section prior to flue gases entering the convective section.

The furnace sections employ a special "cyclone" antechamber to the main boiler, in which fuel and air are intensely mixed and combusted with at least the stoichiometric quantity of combustion air. The most important design criterium was maintaining extremely high combustion temperatures (greater than 3000° F.) and extended residence times by which to ensure complete conversion of inorganic ash to a fluid molten physical state. The intense fuel and air mixing ensures high combustion gas temperatures within the cyclone, transforming coal ash into a byproduct liquid to collect in the furnace bottom for subsequent removal. This feature of the combustion process significantly reduces flue gas ash content and the associated erosion potential. As a result, the flue gas velocity can be increased to 60–85 aft/s without concern for erosion of steam tubes, thus reducing the physical size of the boiler convective section. Consequently, the cyclone section allows boiler size and cost to be reduced.

An undesirable consequence of the intense mixing in the cyclone section is a high $NO_x$ emissions production rate. The intense mixing of fuel and air provides very high combustion temperatures, promoting $NO_x$ formation from atmospheric nitrogen. In addition, the same intense mixing exposes fuel-contained nitrogen to oxidizing conditions, increasing the contribution of fuel-derived nitrogen to $NO_x$. In summary, cyclone boilers generally are recognized as high $NO_x$ producing devices, unless corrective action is taken.

Previous investigators have proposed various combinations of water and steam injection for $NO_x$ control. For example, U.S. Pat. No. 5,029,557 to Korenberg discloses adding steam to reduce $NO_x$ formation during combustion for a cyclone combustion apparatus. However, the apparatus described in the Korenberg patent employs only steam for injection, and thus does not exploit the additional heat of vaporization available by using water as a diluent agent. Deploying a steam injection apparatus as described in the Korenberg patent may require considerable cost, as well as complicated operation during non-steady operation such as load changes.

U.S. Pat. Nos. 3,748,080 to Dunn and 3,809,523 to Varekamp disclose the use of water injection for $NO_x$ control, but require the injection directly onto a flame front, to maximize the ability to quench combustion reactions early in the process. Although this concept is desirable in terms of minimizing the contribution of thermal $NO_x$, the high quench rate could actually increase the uncombustible content (CO, unburned hydrocarbons) in the product gas.

A different approach described in other patents introduces cooling media directly into the fuel source prior to combustion. For example, U.S. Pat. No. 4,533,314 to Hieberling discloses a process of using a cooling medium, for example steam or previously cooled combustion products, injected into a zone between the introduction point of gaseous fuel and combustion air, providing cooling and a diluent to control temperatures. U.S. Pat. No. 4,152,108 to Reed discloses a device that injects steam simultaneously with gaseous fuel for cooling and to provide a diluent effect. U.S. Pat. No. 4,394,118 to Martin discloses introducing water vapor into a plurality of combustion zones, apparently reproducing the fuel mixing conditions in a gas turbine environment, to control combustion temperature. U.S. Pat. No. 3,860,384 to Vulliet discloses introducing moisture into combustion air prior to the combustion chamber, with preheating. Other references disclose mechanical devices for introducing water or steam with fuel, or employing additional momentum provided by the mixing media for improved mixing of fuel in combustion air.

In light of the limitations of the known processes in the field of fluid water injection for carbonaceous material combustion $NO_x$ control, there has been a need for a simple, easily retrofitable process and apparatus for optimizing water injection for reducing the level of $NO_x$ particularly in cyclone boilers. Such an apparatus should not require separate fuel premixing chambers and the added expense necessary for additional plant maintenance duties.

Thus an improved process for limiting the amount of nitrogen oxides produced from the flame zone of a cyclone boiler which overcomes and eliminates the deficiencies of the known processes would be very beneficial.

SUMMARY OF THE INVENTION

The present invention has been made in view of the above-described inadequacies of the related art and has as an object to provide a new water injection NOx control process and apparatus particularly useful for cyclone type boilers which overcomes and eliminates the inadequacies of the prior art.

It is another object of the present invention to provide a low cost yet effective apparatus and method for deploying water injection for $NO_x$ control in cyclone boilers used for utility steam generation, particularly cyclone boilers fired by natural gas and/or fuel oil.

It is yet another object of the present invention to provides low cost $NO_x$ control with minimal special equipment needed for mixing fuel and water, and for mixing cooling air, and that is easily controllable over a range of operating conditions.

It is still another object of the present invention to provide a $NO_x$ control system that requires minimum capital cost, and that is easily retrofit to an existing cyclone boiler.

To achieve the objects of the invention, as embodied and broadly discussed herein, the present invention is a process and apparatus for limiting the amount of nitrogen oxides created during the combustion of a fossil fuel, and is particularly applicable to cyclone type coal combustion boiler furnaces. The process and apparatus of the present invention limits the amount of nitrogen oxides ($NO_x$) produced during the combustion of a fossil fuel (e.g. natural gas, fuel oil and coal) in a cyclone type boiler furnace by injecting water into the secondary air supply. The air supply is primarily cooled by the heat of vaporization of the water, which is finely dispersed into the secondary air by a series of specially constructed and arranged injectors, thus reducing the quantity of heat contained within the combustion air delivered to the flame. To avoid quenching combustion, substantially all of the water is vaporized prior to exiting the cyclone section.

In the present invention, mixing of fuel and water is carried out within the secondary air supply. This innovative and simplifying construction concept is enabled by the use of specially constructed and located injectors which efficiently atomize and disperse the water. For natural gas and fuel oil, preferably about 2.5 to 10.0 gallons of water are injected per million BTUs of heat fired as either natural gas or oil. Water is injected through existing ports originally provided in cyclone boilers for use as secondary air calibration ports or, alternatively through ports originally provided for use as oil deslagging system ports. V-jet type spray nozzles are utilized to achieve a uniform dispersion of water in the combustion air. The location of the nozzles is selected to maximize heat extraction from the flame, while not quenching the flame. A process control system may be utilized to inject a quantity of water proportional to the quantity of fuel fired, for single fuel, and multiple fuel (e.g. both oil fuel and gas fuel) cyclone boiler fuel systems.

The above and other additional objects and advantages of the present invention will become apparent from the detailed description which follows, especially when considered in conjunction with the accompanying drawing figures.

DETAILED DESCRIPTION OF THE PREFERRED EMBODIMENT

Figure 1:
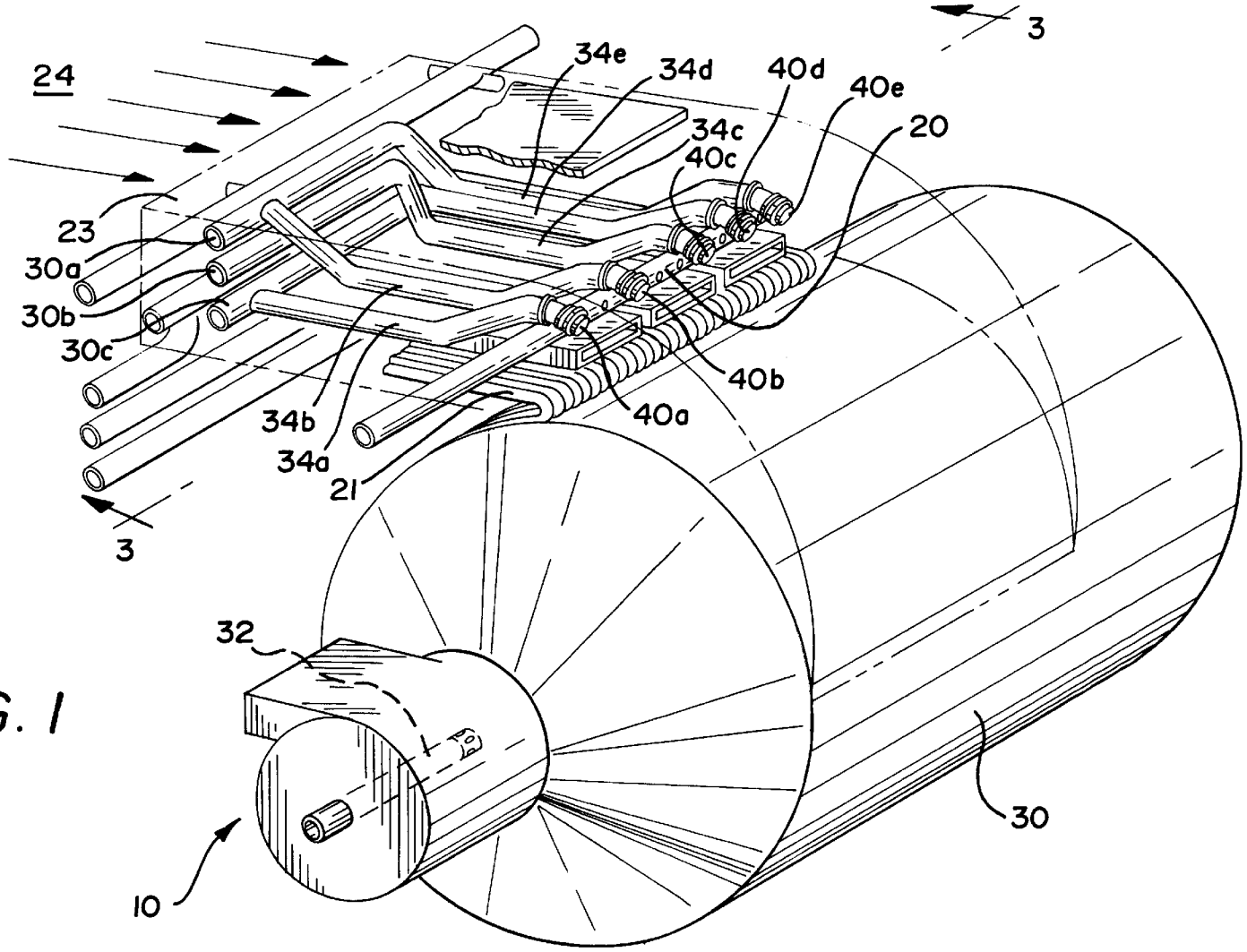
FIG. 1 is a perspective illustration of a cyclone boiler furnace including a secondary air plenum chamber with a water injection apparatus in accordance with a preferred embodiment of the present invention.

To achieve the objects of the invention, a process and apparatus in accordance with a preferred embodiment of the invention achieves a reduction in the amount of nitrogen oxides ($NO_x$) formed during combustion of a carbonaceous fuel in a cyclone type boiler. The invention is particularly practical for use in conjunction with the furnaces of a cyclone boiler which has been converted for use for the combustion of natural gas and fuel oil, fuels for which $NO_x$ is produced primarily from "thermal $NO_x$" sources controllable by minimizing combustion temperature and for which substantially no slag is produced. However, the process and apparatus may also be applied to coal combustion, as "thermal $NO_x$" is a significant factor in the total $NO_x$ produced from coal-fired boilers.

The present invention is distinguishable from the known processes in several important aspects including: the use of existing access ports to inject cooling media, preferably water, into the cyclone section; the co-injection of water and fuel; the optimized placement of injection nozzles for the injection of optimally sized water droplets to maximize $NO_x$ reduction; the vaporization of substantially all of the water droplets prior to contact with the flame zone; and the implementation of a proactive control process driven by a boiler digital control system (DCS) to tailor the correct quantity of water injected depending on process conditions.

Several test programs have been conducted which provide data supporting the benefits of the invention. A proof-of-concept test identified the potential benefits of the technology, and a second test demonstrated the benefits of $NO_x$ reduction using an optimized system.

One of the primary advantages of the present invention is the cost saving utilization of existing access ports for the injection of the cooling media, preferably water, into the cyclone furnace. Otherwise, injection of water into the cyclone furnace would require the installation of special ports to provide access for an injection lance, or alternatively an expensive special pre-mixing chamber would have to be constructed to intimately mix the cooling media and the fuel. These ports would likely require making several penetrations of the thick wall high pressure steam tubing, increasing capital cost and possibly compromising availability and performance (e.g. due to additional tube bends) of the furnace. However, most cyclone boilers in current use already have two or more existing ports. The present invention adapts one or more of these existing ports to inject water as a cooling medium to limit the level of $NO_x$ produced.

The first category of access ports applicable to the invention were originally provided in the secondary air plenum chamber for the installation of pressure sensing lines for determining combustion air velocity distribution within the cyclone section. In accordance with the present invention, these access ports can be deployed for the injection of water to limit $NO_x$ production. Although it is still desirable to maintain the ability to monitor combustion air velocity distribution, monitoring on a continuous or daily/weekly basis is not necessary or desirable. Rather infrequent validations of the uniformity of the distribution of combustion air (e.g. at annual outages) is acceptable for most boilers. These velocity measurements can be conducted under cold-flow conditions (without fuel fired in the boiler). The pressure sensing access ports are more suitable for water injection (rather than steam injection), due to the limited diameter of the access openings and the restriction on the mass of steam that can be injected. The combustion air velocity distribution can be determined at select periods when $NO_x$ control is not necessary such as during normally scheduled shut-down periods. During these periods, the water injection equipment is removed from the furnaces, and the air velocity distribution is tested. After the testing, the water injection equipment is reinserted.

The second category of ports applicable to the invention were initially intended for use in a "deslagging gun" operation on fuel oil to augment heat release within the cyclone combustor when firing coal. The oil gun was initially utilized to control flame temperature within the cyclone, providing the boiler operator with an additional method to maintain coal deslagging. The oil-fired "deslagging" gun is not required for cyclone boilers firing gas and/or oil (and thus not producing ash which can slag), and may not be required for many coal-fired boilers in the future.

Although both class of ports may be advantageously utilized for injecting water into the secondary air of cyclone type boilers in accordance with the present invention for the purpose of controlling $NO_x$, it is preferable to utilize the pressure sensing ports. Although less preferable to using the pressure sensing ports alone, water may be injected into the oil deslagging port alone or in combination with the pressure sensing ports.

During initial tests using the injection port for the deslagging gun, steam was injected to conduct proof-of-concept tests. The innovative utilization of this port reduces the capital cost of steam or water injection for $NO_x$ control. Similarly innovative is utilization of a location for injecting water in the pressure tap ports originally intended for use in the determination of combustion air velocity distribution.

Liquid water is the preferred medium for controlling flame temperature compared to steam because of its ability to extract about twice as much amount of heat providing greater flame zone temperature reducing ability. Water is also easier and cheaper to obtain.

Testing has shown that steam injection delivered only marginal No. reduction. Specifically, in a series of "proof-of-concept" tests, steam was injected through the deslagging gun access port. $NO_x$ emissions were monitored at the stack and demonstrated no more than a 5% $NO_x$ reduction for natural gas. These results, which are shown in Table 1, demonstrate that, under the test conditions steam did not provide significant $NO_x$ reduction. It is possible that steam injection could have provided greater $NO_x$ reduction if significant and likely expensive modifications to the cyclone section and combustion air velocity systems were conducted to increase the quantity of steam that could be injected.

TABLE 1

TEST RESULTS—STEAM INJECTION FOR $NO_x$ CONTROL

| Fuel Type | Generating Capacity (MW) | $NO_x$ Without Steam Injection | lbs steam / MBtu | $NO_x$ With Steam Injection |
|---|---|---|---|---|
| natural gas | 375 (test #1) | .28 | 2.5 | .27 |
| natural gas | 400 (test #2) | .28 | 2.5 | .26 |

As a consequence of the results using steam injection as shown in Table 1, additional tests were conducted using water injection as the cooling media for $NO_x$ control. These tests employed a simple water injection lance installed through the port for pressure sensing taps for combustion air velocity distribution. Table 2 summarizes results of this test series to evaluate the role of water injection on $NO_x$ reduction.

TABLE 2

TEST RESULTS—WATER INJECTION FOR $NO_x$ CONTROL

| Fuel Type | Generating Capacity (MW) | $NO_x$ Reduction (%) | Gallons Water/ 100 lbs Fuel |
|---|---|---|---|
| natural gas | 375 | 25 | 2.5 |
| natural gas | 400 | 30 | 2.5 |
| natural gas | 300 | 35 | 3.25 |
| natural gas | 200 | 40 | 5.0 |
| fuel oil | 375 | 10 | 5.0 |
| fuel oil | 300 | 10 | 3.25 |
| fuel oil | 200 | 10 | 2.5 |

Results in Table 2 demonstrate the clear and unambiguous superiority of employing water rather than steam for $NO_x$ control. Specifically, each unit mass of water can deploy the latent heat of vaporization, in addition to absorbing sensible heat from ambient, to minimize combustion temperatures. Conversely, the principle role of steam is as a thermal diluent, without the latent heat of vaporization available to provide additional cooling. Finally, the use of water significantly increases the net cooling that can be delivered to the combustion system through a constricted orifice such as the ports provided for the oil deslagging gun, or provided for the combustion air distribution pressure sensing taps. Specifically, the mechanical configuration described above and employed in the proof-of-concept tests allowed about 70–80 gpm of water to be delivered to the cyclone combustion section. This quantity of water provides, on a BTU-removed basis, approximately 5 times the cooling effect of the quantity of steam injection that can be injected through the limited access. Thus the use of water in accordance with the present invention is superior to the use of steam in that greater heat (e.g. BTU/hr) is extracted from the flame.

Figure 2:
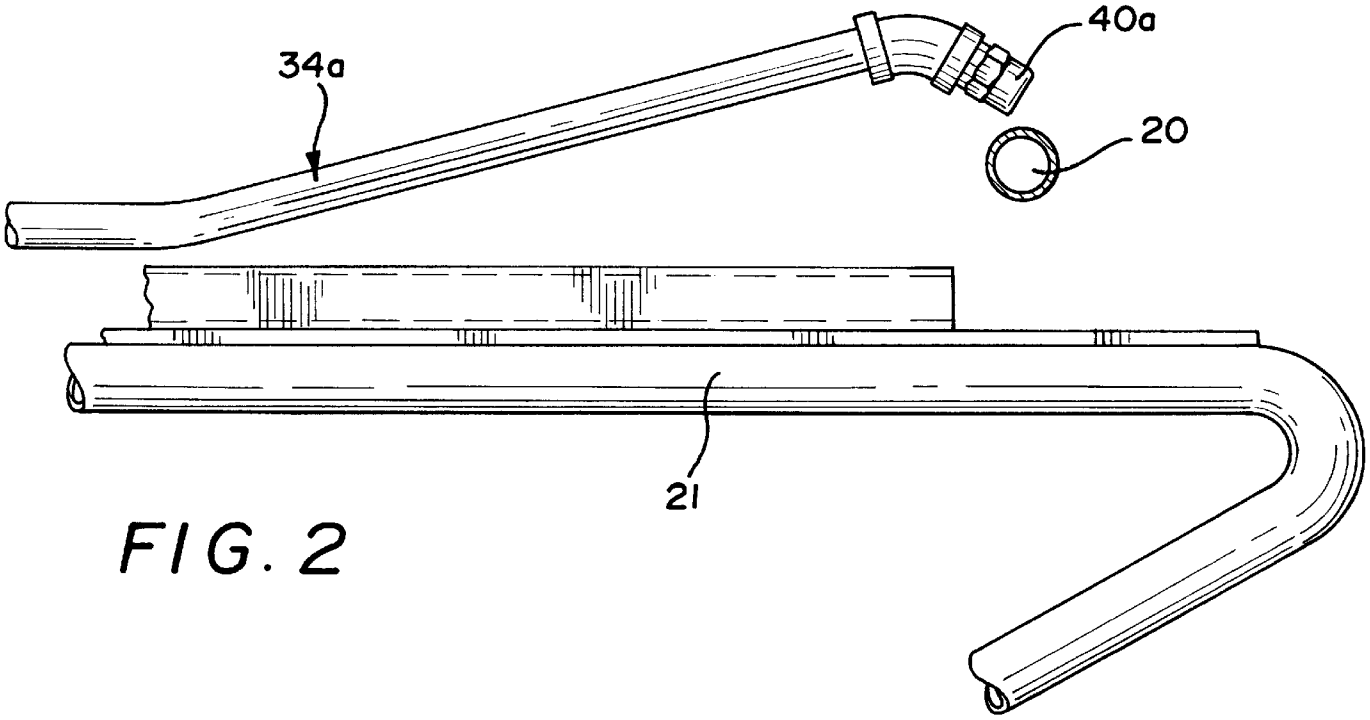
FIG. 2 is a partial-side view of a portion of the water injection apparatus of FIG. 1.

FIG. 1 illustrates a cyclone boiler 10 having a secondary air plenum chamber 23. Within the walls of the secondary air chamber 23 are included three ports 30*a*, 30*b*, and 30*c* originally provided for testing combustion air velocity distribution. Any or all of these ports can be utilized to introduce water to supply the five V-jet water injectors 40*a*, 40*b*, 40*c*, 40*d*, and 40*e*. FIGS. 1 and 2 show modifications to a furnace unit in accordance with a preferred embodiment of the invention in which the air velocity distribution ports 30*a*, 30*b*, and 30*c* are utilized to introduce water. A plurality of series of pipes 34*a*, 34*b*, 34*c*, 34*d*, and 34*e* run from a water supply system (not shown) and extend through the ports 30*a*, 30*b*, or 30*c* ending at the five V-jet water injectors 40*a*, 40*b*, 40*c*, 40*d*, and 40*e*. While the preferred assembly is to have water injected through three ports 30*a*, 30*b*, or 30*c* leading to five parallel water piping paths 34*a*, 34*b*, 34*c*, 34*d*, and 34*e* and ending with five V-jet water injectors 40*a*, 40*b*, 40*c*, 40*d*, and 40*e*, other injection assemblies could alternatively be employed. One alternative is to inject water through the port used for the oil deslagging gun 20 (preferably when not burning fuel oil).

The V-jets utilized are preferably capable of spray injecting droplets of liquid water into the combustion air. The cyclone boiler 10 preferably employs at least one cyclone combustion chamber as exemplified by combustion chamber 30, which has been modified for use with fuel oil or gas with a fuel inlet of either gas burners 21, or an oil deslagging gun 20 used as a main oil burner. In such a modified cyclone, old main oil burner 32 is typically no longer used. Water injected through the V-jets is mixed with secondary air 24 flowing through the secondary air plenum chamber 23.

Another process improvement provided by the present invention is an optimized water injection system that maximizes heat extracted from the flame, but does not impair combustion. The arrangement of the water injection apparatus does not inject water directly onto the flame, risking the quenching of combustion reactions and the production of hydrocarbons and CO, but instead co-injects the cooling water with the fuel, thus optimizing $NO_x$ reduction. The desire to avoid quenching of flame reactions is a key reason why water is injected into secondary and not primary air. In this manner, the water must be injected into secondary air in a manner that provides for uniform dispersal, so that virtually all of the latent heat of vaporization is utilized prior to exiting the cyclone section, reducing the possibility of water droplets quenching the flame.

Figure 3:
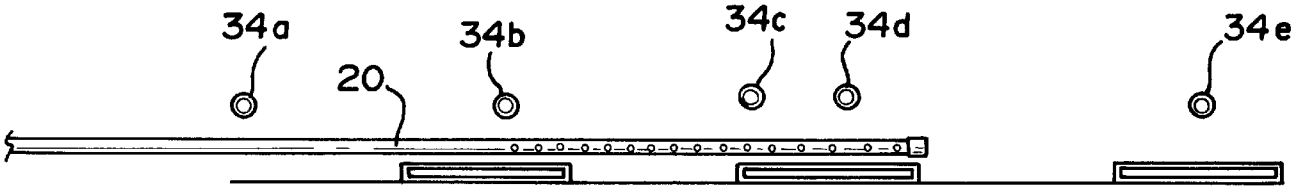
FIG. 3 is a partial view from along perspective lines -3-3—in FIG. 1.

The preferred spacings and locations of the water injection V-jet nozzles 40*a*, 40*b*, 40*c*, 40*d*, and 40*e* for $NO_x$ reduction within a cyclone combustion chamber are illustrated in FIGS. 1 and 3. These nozzle locations were optimized through the use of a cold-flow physical model simulating the dynamics of combustion air entering the cyclone chamber. The criteria for success was achieving maximum dispersal of water droplets in the simulated combustion air stream. The five V-jets 40*a*, 40*b*, 40*c*, 40*d*, 40*e* are used to inject water into the combustion air for cooling at a location prior to reaching the flame zone. Cold-flow modeling of the air flow patterns in the ductwork or other means is used to optimize the V-jet location. It is important that the V-jets be located in positions such that injected water is substantially completely evaporated prior to exiting the cyclone section, to avoid moisture impingement on the flame and possible production of unburned fuel constituents such as CO and hydrocarbons. The results of the cold flow modeling and the demonstration tests confirm that the V-fan water jets should be located in the layer between the inlet natural gas injectors and the combustion air. During normal plant load periods when natural gas fuel is being fired, preferably three of the five locations are utilized to introduce water. During normal load plant periods when fuel oil is being fired, preferably all five of the locations are utilized to introduce water. All five of the locations are also utilized when coal is being fired and also when both natural gas and fuel oil are fired simultaneously. During low load plant periods, from one to three of the locations are utilized to inject water as may be necessary based on the load. It should be noted that both natural gas and fuel oil fuels are preferably injected with a momentum tangential to the progression of combustion products through the cyclone combustion chamber, and that water is preferably injected in the interlayer spacing between the zone of fuel and air introduction.

The approximate spacing between the gas injectors and combustion air inlet zone is preferably about 6 inches. The V-jet nozzles may be oriented to spray water at an angle of between about 20 and 160 degrees with respect to an axis running along the center of the nozzle. While it is most preferred to use five V-jet nozzles as described, any number of V-jet nozzles could be used. Preferably the number of V-jet nozzles utilized is between about 2 and 20 V-jet nozzles. A cold-flow model can be used to determine the optimum locations for each of the V-jet nozzles within the secondary air plenum chamber. The cold-flow model should take into consideration similar geometry and airflow characteristics to the cyclone combustion chamber. The V-jet nozzles are preferably located within the plenum section of the secondary air inlet duct, such that water can be injected into a zone of relatively uniform combustion air velocity distribution (substantially all of the air traveling at velocities within about 10% of each other), and in a plane interspatial to the plane of fuel introduction for fuel oil and/or natural gas or the central axis of the crushed coal introduction.

For both natural gas and fuel oil, the cold flow modeling proved that a V-jet type mechanical atomizer creating a "fan" type spray provides an optimal distribution of water by maximizing the quantity of water delivered to the interlayer spacing of air and fuel while minimizing the quantity of water droplets that directly impact upon the flame zone such that substantially all of the water droplets are vaporized prior to leaving the cyclone.

Table 3 summarizes data from a series of tests showing the effectiveness of water injected employing both (a) pressure sensing ports to access water supply to the cyclone section, and (b) fan spray nozzles for water introduction between the natural gas and combustion air. These tests show an average of 35% $NO_x$ reduction achieved, with 150–200 gpm injected.

TABLE 3

SUMMARY OF DEMONSTRATION RESULTS
WATER INJECTION FEASIBILITY FOR NOX CONTROL
NATURAL GAS FUEL
WATER INJECTED THROUGH COMBUSTION AIR VELOCITY PORTS

| Test Series | Generating Capacity (MW) | NOx Reduction (%) | Water Injection (gpm) | Nozzles in Service | lbs water/ MBtu fuel |
|---|---|---|---|---|---|
| 1.1 | 165 | 15 | 30 | 1 | 1 |
| 1.2 | 163 | 17 | 47 | 1 | 1.6 |
| 1.3 | 167 | 33 | 57 | 1 | 1.9 |
| 1.4 | 165 | 37 | 37 | 3 | 1.3 |
| 4.1a | 396 | 25 | 94 | 3 | 1.4 |
| 4.2b | 393 | 33 | 124 | 3 | 1.8 |
| 4.3c | 392 | 37 | 141 | 3 | 2.1 |
| 4.2b | 400 | 32 | 125 | 3 | 1.8 |
| 4.3b | 390 | 41 | 141 | 3 | 2.1 |
| 4.4b | 402 | 41 | 159 | 3 | 2.3 |
| 4.5 | 401 | 46 | 168 | 5 | 2.4 |
| 4.6 | 389 | 54 | 215 | 5 | 3.2 |

TABLE 4

| Do Microns | T = | 600 t(600 F) | 2000 t(2000 F) | 2500 t(2500 F) | 3000 t(3000 F) | 3500 t(3500 F) |
|---|---|---|---|---|---|---|
| 10 | | 1.2 | 0.3 | 0.3 | 0.2 | 0.2 |
| 25 | | 7.6 | 2.0 | 1.7 | 1.4 | 1.3 |
| 50 | | 30.3 | 8.0 | 6.6 | 5.7 | 5.1 |
| 75 | | 68.1 | 18.0 | 14.9 | 12.9 | 11.5 |
| 100 | | 121.0 | 32.0 | 26.5 | 22.9 | 20.4 |
| 150 | | 272.4 | 72.0 | 59.6 | 51.6 | 45.9 |
| 200 | | 484.2 | 128.0 | 106.0 | 91.7 | 81.7 |
| 400 | | 1936.8 | 511.9 | 423.9 | 366.8 | 326.7 |

The advantages of using direct water injection over steam are significant in terms of cost, which can be estimated for a simple example case comparing the cost incurred for each and the cost per ton of $NO_x$. The use of steam incurs a number of costs in terms of capital and operating penalty.

Diverting steam intended for the power-producing turbine to use as a thermal diluent represents an under-utilization of investment in power production equipment. For many plants, the maximum generating capacity is determined by the steam production rate achievable by the boiler. Accordingly, diverting steam from power to $NO_x$ reduction represents a limit to power production capability. For example, the diversion of 2.5% of the boiler steam production capability of a 400 MW cyclone boiler for $NO_x$ control provides an equivalent steam flow equal to 125 gpm of water. This mass flow rate (62,000 lbs/hr) induces an approximate 2.5% reduction in plant generating capacity (e.g., 10 MW). For the purpose of this calculation, the cost assigned to this lost capacity is the capital carrying charge for a replacement power facility, calculated over the remaining lifetime of the station to which steam injection for $NO_x$ control is deployed (to provide an additional 10 MW to compensate for the 10 MW of capacity "lost" to $NO_x$ control). For this example case, it is assumed the least cost replacement generation is provided by natural gas fired combustion turbines. Assuming a combustion turbine capital requirement of $500/KW, and an annual capital recovery cost factor of 0.106 (for a 30 year lifetime, current dollar basis) the annual cost to retain existing capacity is $530,000.00.

A representative 400 MW boiler unit produces approximately 2,700,000 lbs steam/hr. Given the delivered cost of natural gas of $2.25/MBTU and that each lb. of steam requires approximately 1000 BTU, 2.5% of boiler capacity directed to steam injection for NO, control, the equivalent fuel cost for continuous, full load operation is about $152/hr at maximum capacity. At 65% capacity factor, the annual operating cost is $865,000.00.

The cost for city water supply is approximately 0.60/1000 gal, translating into $0.07/1000 lbs steam. If a total of 2.5% of the boiler capacity is used for $NO_x$ control, the hourly water supply cost at maximum capacity is $4.50, or $25,000.00 annually at 65% capacity factor. To produce steam, boiler makeup water must be treated with a de-ionization process to avoid deposition in tubes. The cost to provide for makeup for producing deionized water is about $1.20/1000 gallons for a conventional city water supply. Using the quantities determined above, the cost is approximately $50,000.00 annually.

In summary, the cost to direct 2.5% of the steam capacity to NO, control would require a total of approximately $1,400,000.00 to replace lost generating capacity and higher operating cost.

The operating cost for water injection is derived from the data in Table 2, which was developed based on earlier test results showing an average of 72 gpm provided about a 33% $NO_x$ reduction from 205 ppm (at 375 MW load).

The cost for city water supply, at the rate of approximately 0.60/1000 gallons, is the same as for using steam for $NO_x$ control (about $25,000.00 annually).

Although water injection avoids boiler steam production penalties, additional latent heat absorbed by the flame is no longer available to contribute to boiler thermal efficiency. A water injection rate of 125 gpm at full load for the 400 MW translates into a boiler thermal efficiency of approximately 1.83%, as determined by calculating the impact of injected water on the boiler enthalpy change. The additional fuel consumption at maximum plant generating capacity for this thermal efficiency penalty is $173/hr, equivalent to about $985,000.00 annually at a 65% capacity factor.

Accordingly, the use of water injection at 400 MW incurs an annual cost at 65% capacity factor of about $1,000,000.00. Thus, water injection cost is approximately 65% of that for using steam for the relatively common case where boiler steam production rate determines plant generating capacity.

This invention allows the use of water injection as a cooling media in greater quantities than could be deployed with steam. The role of steam versus water in limiting $NO_x$ formation is demonstrated by the graphs in FIGS. 7 and 8, which show the relationship between the quantity of water injected (in terms of gallons of water per MBtu fired in the furnace) and two key variables: a) the adiabatic flame temperature, and b) the calculated $NO_x$ concentration that would be produced if combustion products were allowed to reach thermodynamic equilibrium. As the production of $NO_x$ in natural gas flames is exclusively derived from nitrogen in combustion air, the adiabatic flame temperature is one surrogate by which to measure the value of water versus steam injection in controlling $NO_x$. In addition, although $NO_x$ levels measured in the cyclone boiler will not reach levels dictated by thermodynamic equilibrium, the relative values of the calculated equilibrium concentration are indicative of the role of water versus steam injection.

Figure 7:
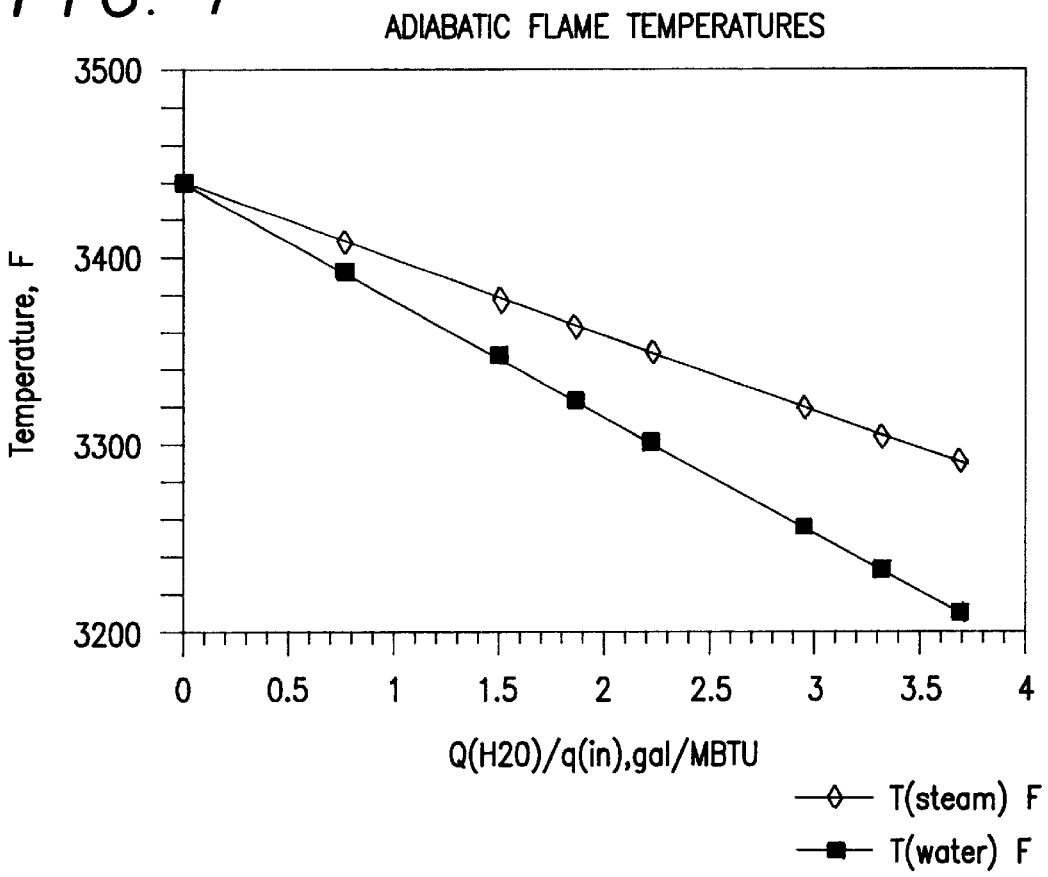
FIG. 7 is a first graph of adiabatic flame temperatures vs. Q in accordance with the present invention.
Figure 8:
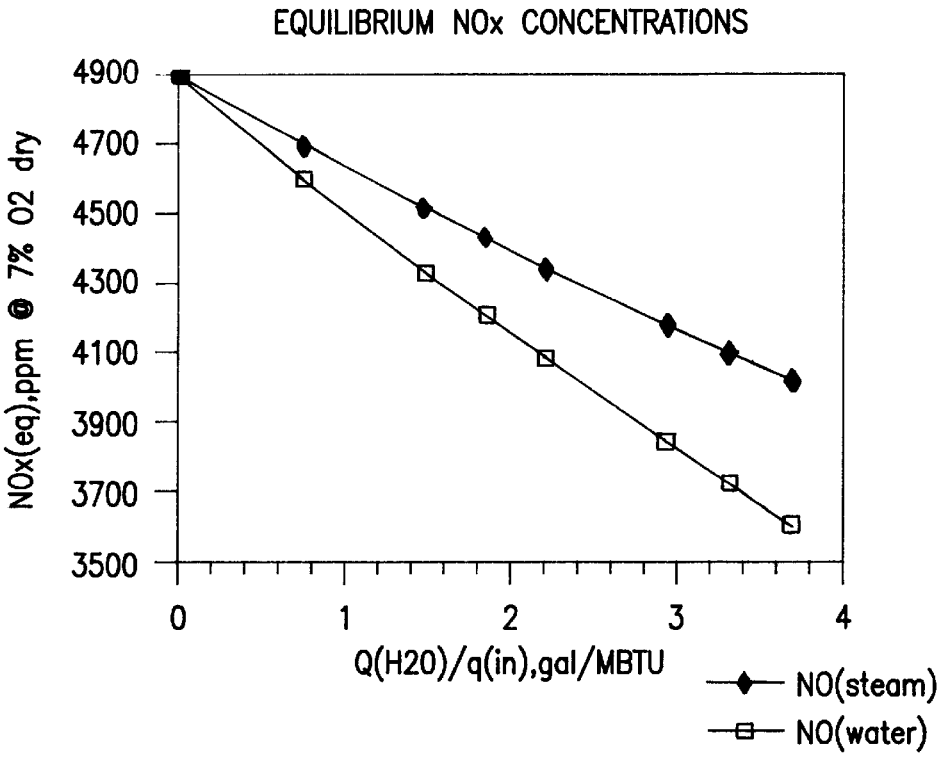
FIG. 8 is a second graph of adiabatic flame temperatures vs. Q in accordance with the present invention.
Figure 9:
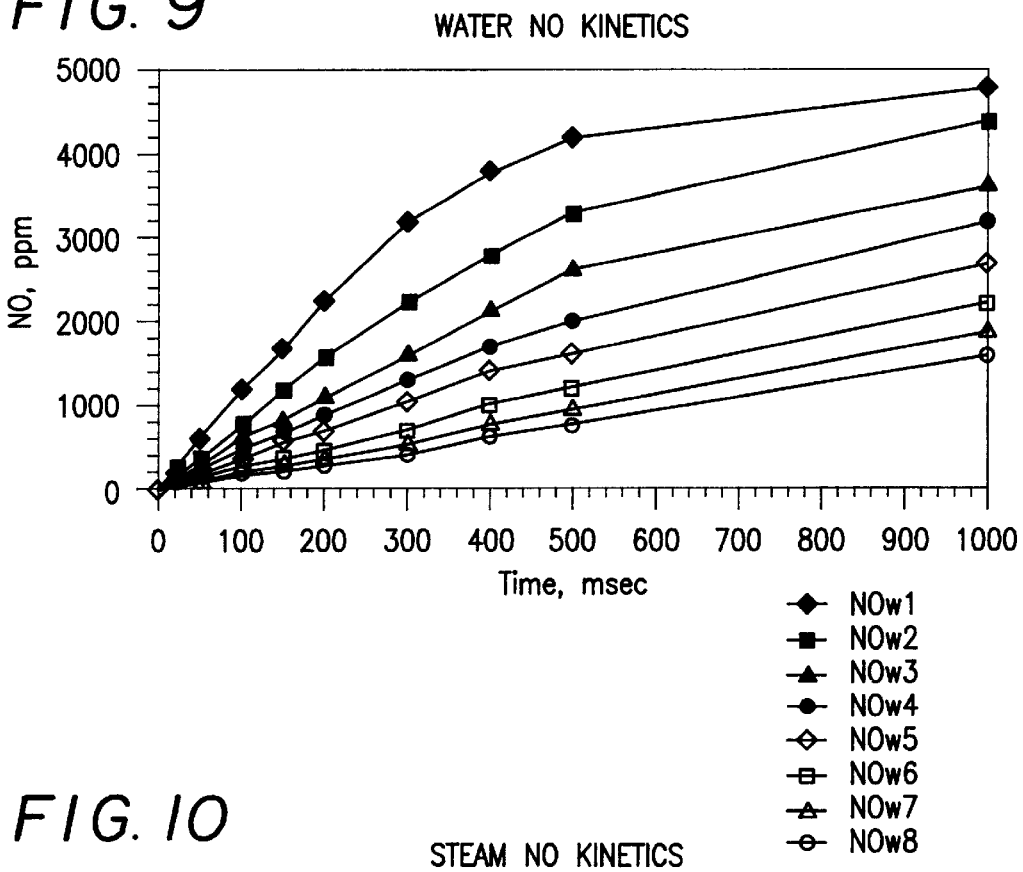
FIG. 9 is a first graph of water kinetics in accordance with the present invention.
Figure 10:
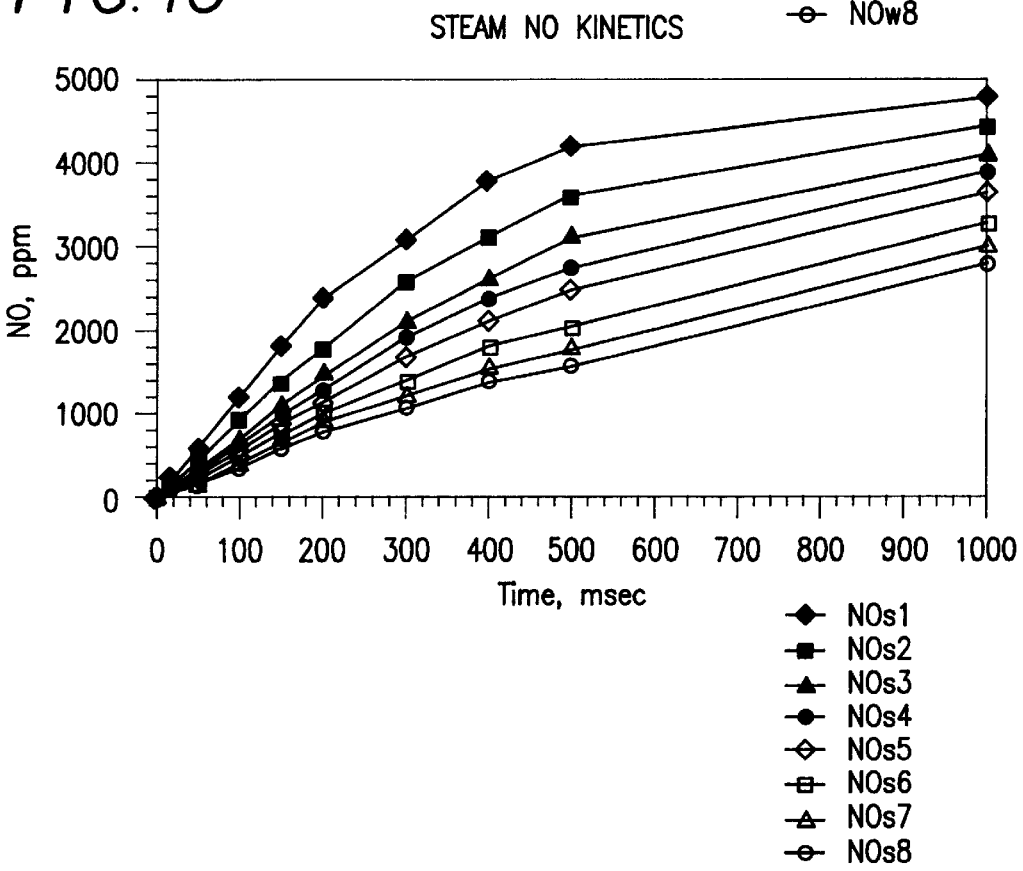
FIG. 10 is a second graph of water kinetics in accordance with the present invention.

Note that in FIGS. 7 and 8 both steam and water are compared, with the steam injection rate expressed as the equivalent gallons required to produce the steam. FIGS. 7 and 8 show that at equal injection rates corresponding to the maximum water injection rate for the test case of 3.7 gals/MBtu, the use of water versus steam provides greater reduction in temperature by almost 100° F. The significance of this fact is recognized by the relative value of equilibrium $NO_x$ levels, shown in FIG. 8. This chart shows that if allowed to approach equilibrium, at the same injection rate, water provides almost 400 ppm more $NO_x$ reduction compared to steam.

The relative advantages of water versus steam are even greater when the practical limitations of the technologies are considered. Specifically, the preceding discussion assumed that equal quantities of cooling media are injected into the cyclone combustion chamber. However, as previously discussed, this is not the case, as the unique V-jet water injection apparatus employing existing access ports for determining combustion air velocity distribution allows for a considerably greater quantity of cooling medium to be injected as water. Specifically, the data in FIG. 8 shows that given the physical constraints of the steam injection system, a cooling medium rate equivalent to 0.2 gal/min or 0.29 gal/MBtu was injected. The use of the water injection apparatus as described allows cooling medium in the quantities of 3.7 gal/MBtu to be injected. Thus FIG. 8 can be used to compare the relative cooling effect of steam injection at 0.29 and water injection at 3.7 gal/min. The net reduction in flame temperature between steam versus water cooling is actually more than 200° F., and if allowed to approach equilibrium, water would provide approximately 1000 ppm lower $NO_x$. Use of the present invention in which substantially all of the injected water is vaporized into steam prior to exiting the cyclone, can result in a total heat of vaporization sufficient to remove enough heat from the secondary air system to effectively limit the combustion temperature to preferably between about 3225° F. and 3325° F. Consequently, both the improved cooling characteristics of water versus steam media and the greater quantity that can be injected improve $NO_x$ control via this invention.

Another unique feature of this invention is the ability to inject water sufficiently close to the flame to reduce temperatures as described previously, while not directly quenching the flame and producing undesirable CO and unburned hydrocarbons. In practice, this is accomplished by finely vaporizing the water into droplets, and not allowing large volumes of water to directly transit through the flame zone. The water injected should be finely atomized such that substantially no droplets remain at the exit of the cyclone combustor section.

As an example, consider a 380 MW cyclone boiler featuring a total of eight separate cyclones. At full load, if the cyclones are 10 ft in diameter and 10 ft in length, at normal boiler/cyclone operating conditions, the residence time required to transit each of the cyclones is between about 60 to 100 msec. Thus, to avoid flame quenching and production of CO and HC, substantially all water injected for $NO_x$ control must be evaporated within this time.

Figure 5:
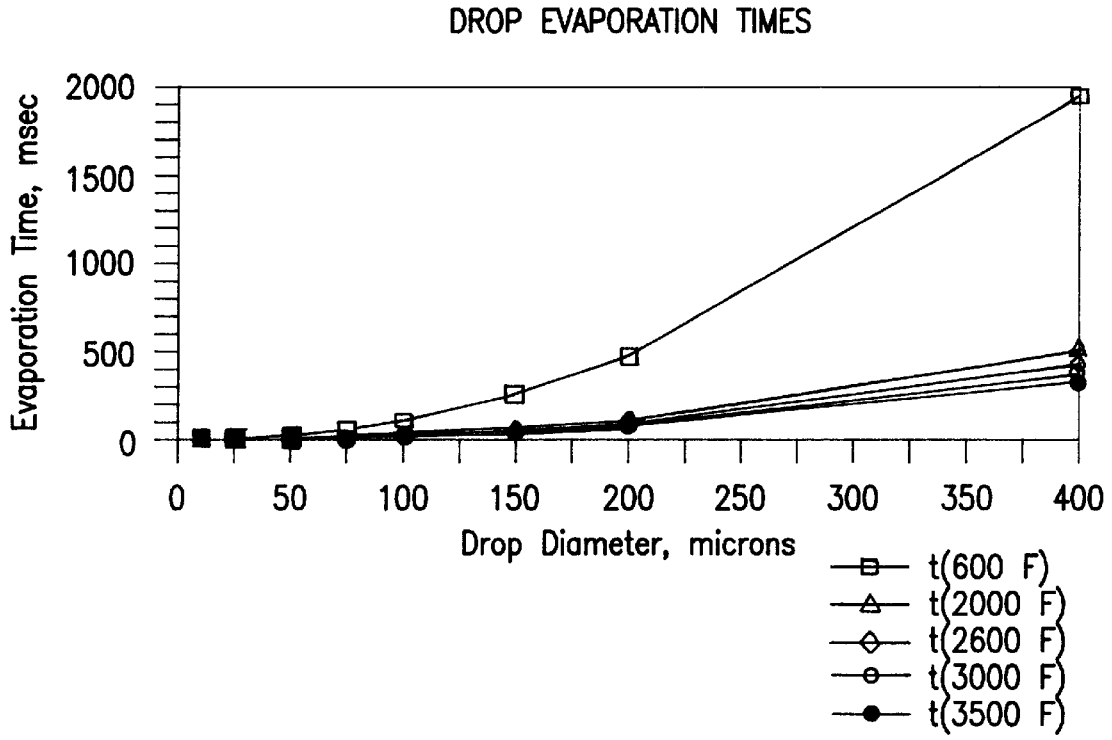
FIG. 5 is a first graph of drop evaporation times vs. drop diameter in accordance with the present invention.
Figure 6:
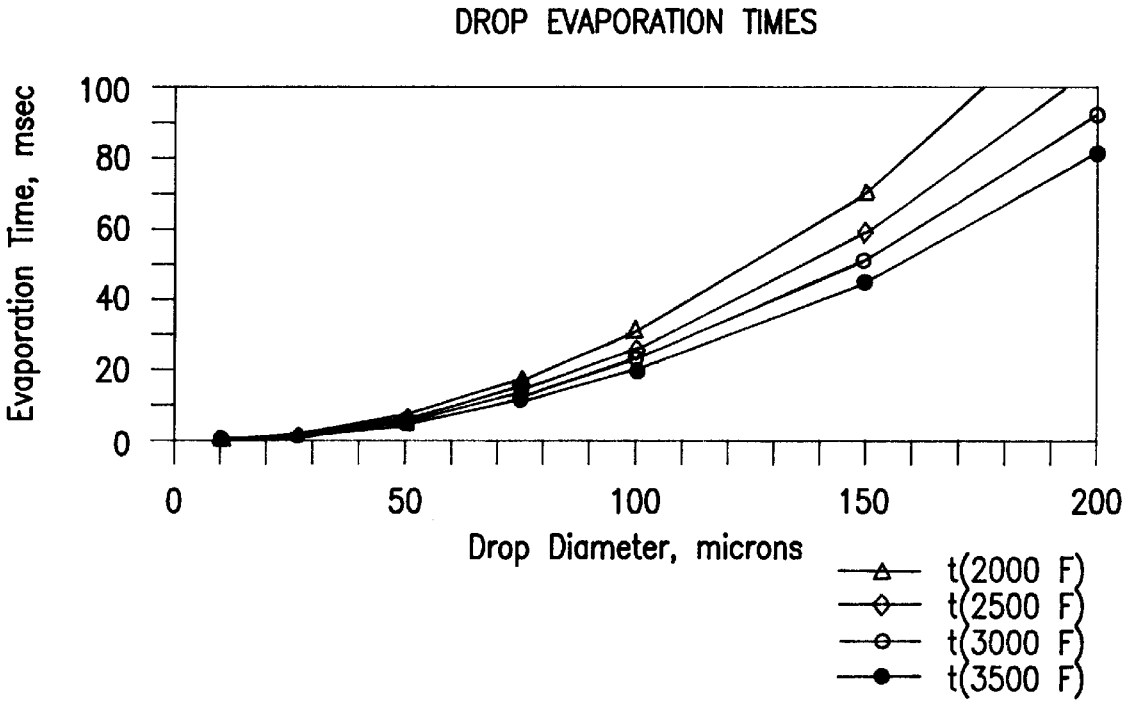
FIG. 6 is a second graph of drop evaporation times vs. drop diameter in accordance with the present invention.

The droplet evaporation time can be calculated for water droplets as shown by the curves of FIGS. 5 and 6 in conjunction with Table 4. FIGS. 5 and 6 as well as Table 4 show that for practical cyclone combustor temperatures (2,500° to 3,500° F.), the time required to fully evaporate a droplet increases with the drop diameter. To avoid opportunity for flame quenching, evaporation should be completed within the 60 msec threshold. Thus, droplets not greater than about 200 microns (and preferably about 100 microns) should be generated by the water injection system. The specific size and operating conditions of the water injection system is selected to provide this level of droplet generation. Accordingly, the invention establishes the conditions for maximizing water injected without flame quenching.

Figure 4:
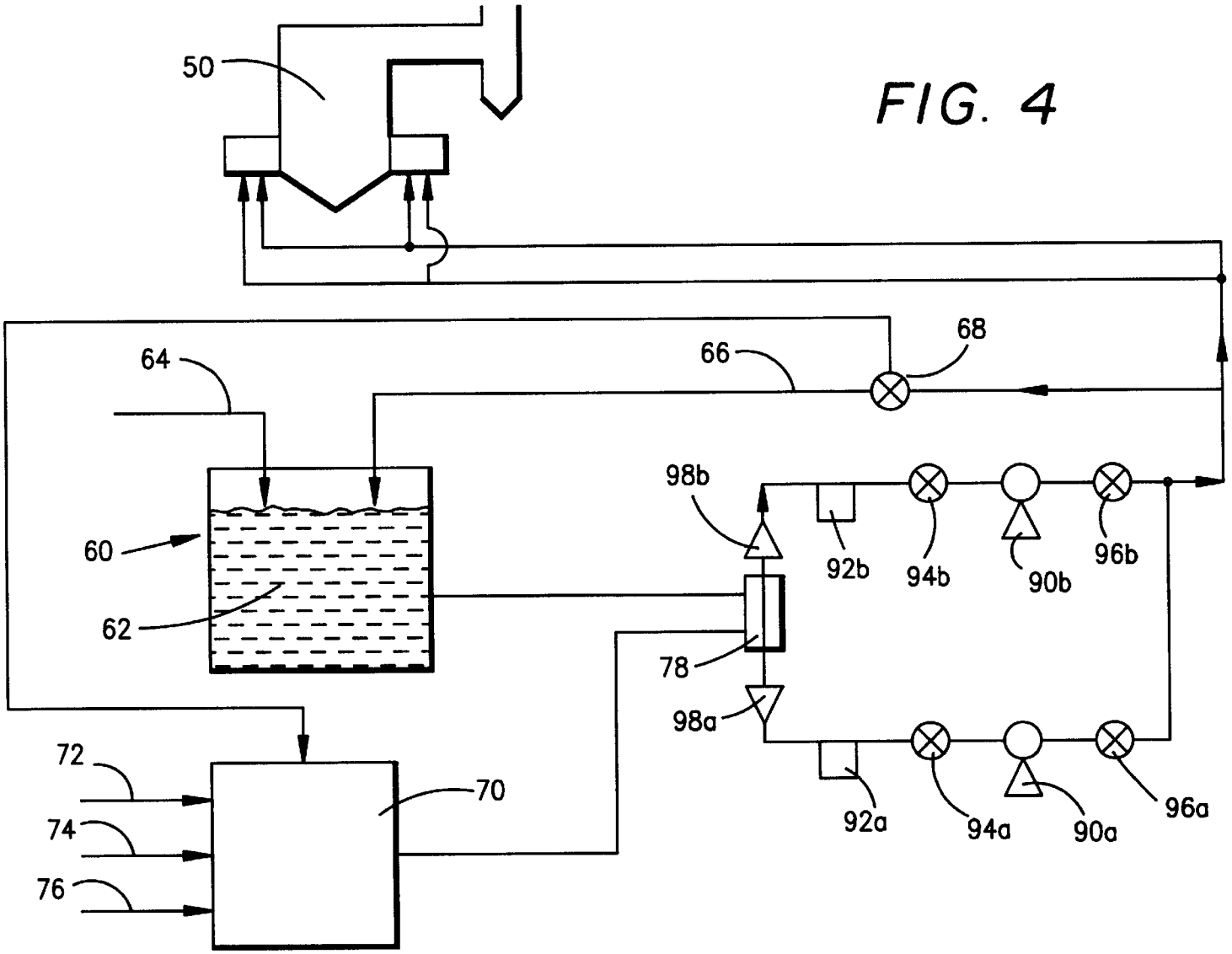
FIG. 4 is a schematic illustration of a process including a control system for water injection for a cyclone boiler in accordance with another preferred embodiment of the present invention.

A further advantage of employing direct water injection in the manner described is to allow the use of a simple, low cost continuous process control method to minimize $NO_x$ production through the use of a distributed control system (DCS) as illustrated in FIG. 4. Recirculating water flow systems, surge capacity, and control valves are constructed of simple components, which can be actuated by the DCS at minimal cost. A completely separate, stand-alone water injection system using a city water source that operates in a manner unrelated to boiler operation can minimize control problems.

A preferred embodiment water injection control system is illustrated in FIG. 4 and includes a cyclone boiler combustion chamber 50, preferably capable of firing either natural gas or combined natural gas/fuel oil, and preferably employing segregated primary and secondary air streams. A system for storing, controlling, and injecting water into the secondary air stream includes a water reservoir 60 containing water 62; two injection pumps 90*a*, 90*b*; a series of water transportation pipes and a distributed control system 70.

The water reservoir 60 preferably uses relatively inexpensive untreated city water through inlet stream 64, along with water recycled by control valve 68 through stream 66. Alternatively, water can be obtained from the plant's reverse osmosis treating system or water from the drains of various condensate lines in the steam cycle.

The two pumps 90*a*, 90*b* are deployed in a manner to allow a two-stage operating mode in which a wide range of flow rates can be accommodated. For low operating loads, injection pump 90*a* is used to provide water for approximately 50% of full load (190 of the plants 380 MW capacity). As the load increases above 50%, injection pump 90*b* is deployed, to provide water through a parallel piping line for operation above 50% load. The injection pumps are preferably sized to operate to effectively provide a flow rate proportional to the fuel flow of the boiler. The general operating range for these pumps should be such that between about 2.5 and 10 gallons of water can be provided for each about 100 lbs of fuel consumed by the boiler. Each pump's piping line may include strainers 92*a*, 92*b*, inlet isolation valves 94*a*, 94*b* and outlet isolation valves 96*a*, 96*b*. Also, a flow recirculation 66 is provided to ensure that a minimum recirculating flow is maintained. Additional control valves and restriction orifices (not shown) may also be utilized to maintain recirculating control. Flow meters 98*a*, 98*b* are included to determine the flow rate of water injected, as a control parameter. The measured flow rate of water is controlled at control box 78 by the DCS 70, for the purpose of maintaining a constant mass ratio of water to fuel. The DCS 70 utilizes measurements of load 72, excess oxygen 74, ambient air temperature 76 to calculate and control the amount of water to be injected into the boiler. The pumps are also controlled by the DCS 70, and preferably include safety trip switches (not shown) for periods of low water in the reservoir.

While steam injection could also be automated in such a manner, the following additional items would likely be required: (a) significant investment for additional piping, valves, etc., to handle high pressure/temperature steam could be excessive, and (b) available steam supply and conditions would be linked to boiler operation. It is possible that the steam production of the turbine and consumption needs for the purpose of $NO_x$ control would not be compatible. Thus liquid water is the preferred cooling medium.

The optimum ratio of water to fuel has been determined by a demonstration test program conducted to document the $NO_x$ reduction achievable using this method. This ratio is maintained by the DCS as determined by weather, the cost of natural gas, and the $NO_x$ reduction required as the operation of the host unit varies to meet system demands. These tests were conducted on an actual cyclone boiler firing both natural gas and fuel oil, and are summarized in Table 4.

The sequence in which water injection nozzles are deployed in the operation of the water injection $NO_x$ control technology is selected to optimize $NO_x$ reduction given the quantity of water injection.

Each of the boiler sections is preferably equipped with five, individual nozzles. When fired by natural gas, a total of one tail three nozzles are deployed in service, depending upon the load. Once the first nozzle is deployed at a minimum load, the second and third nozzles are deployed automatically as load increases, through the operation of a sequencing valve operating off a signal from the DCS.

The remaining two nozzles (fourth and fifth) are deployed in oil-firing only. As such, these nozzles must be activated manually. Once activated, the nozzles are brought back into service at a speed that depends upon the load.

The preceding provides a general description of a cyclone-type power plant boiler unit furnace utilizing embodiments of the present invention. Many aspects of the power plant unit not pertinent to the present invention have been omitted from the description. Furthermore, the present invention can be utilized with cyclone boilers and furnaces which differ from the boiler set-up described.

The foregoing description of the preferred embodiments of the invention has been presented to illustrate the principles of the invention and not to limit the invention to the particular embodiments illustrated. It is intended that the scope of the invention be defined by all of the embodiments encompassed within the following claims, and equivalents thereof.

What is claimed is:

1. A process for limiting the amount of nitrogen oxides produced in the combustion flame zone of a cyclone boiler furnace having a cyclone combustion chamber and a secondary air system, comprising the steps of:

conveying a liquid cooling medium from a source of said cooling medium through at least one port contained within a wall located in a plenum chamber for secondary air of the cyclone boiler furnace to a means for discharging said cooling medium positioned within said plenum chamber at a position where a flow of secondary air has a substantially uniform velocity, said location being prior to the combustion flame zone, and said location selected after utilizing a cold-flow model to determine optimum locations for the discharge of said cooling medium, said cold-flow model simulating the geometry and airflow characterisitics of the cyclone combustion chamber;

discharging said cooling medium into the secondary air system where said cooling medium is mixed with said flow of secondary air;

vaporizing substantially all of said cooling medium prior to contact with the combustion flame, the vaporized cooling medium providing a total heat of vaporization sufficient to lower the amount of heat in the secondary air to effectively limit the combustion temperature; and controlling the amount of cooling medium injected using a control system which utilizes measurements of process conditions.

2. The process of claim 1 wherein said cooling medium is liquid water.

3. The process of claim 2 wherein substantially all of said water is vaporized into steam prior to exiting the cyclone, said portion of water vaporized providing a total heat of vaporization sufficient to remove enough heat from the secondary air system to effectively limit the combustion temperature.

4. The process of claim 2 wherein said conveying is conducted through a series of pipes running from said source of water through said at least one port to said means for discharging.

5. A process for limiting the amount of nitrogen oxides produced in the combustion flame zone of a cyclone boiler furnace having a secondary air system, comprising the steps of:

conveying a liquid water cooling medium from a source of said liquid water cooling medium through at least one port contained within a wall located in a plenum chamber section for secondary air of the cyclone boiler furnace to a means for discharging said cooling medium positioned within said plenum chamber at a position where a flow of secondary air has a substantially uniform velocity, said location being prior to the combustion flame zone;

discharging said liquid water cooling medium into the secondary air system where said cooling medium is mixed with said flow of secondary air; and wherein substantially all of said liquid water cooling medium is vaporized into steam prior to exiting the cyclone boiler furnace to provide a total heat of vaporization sufficient to remove enough heat from the secondary air system to effectively limit the combustion temperature to between about 3225° F. and 3325° F.

6. A process for limiting the amount of nitrogen oxides produced in the combustion flame zone of a cyclone boiler furnace having a secondary air system, comprising the steps of:

conveying a liquid water cooling medium from a source of said liquid water cooling medium through at least one port contained within a wall located in a plenum chamber for secondary air of the cyclone boiler furnace to a means for discharging said cooling medium positioned within said plenum chamber at a position where a flow of secondary air has a substantially uniform velocity, said location being prior to the combustion flame zone, said conveying conducted through a series of pipes running from said source of liquid water cooling medium through said at least one port to said means for discharging;

discharging said liquid water cooling medium into the secondary air system where said cooling medium is mixed with said flow of secondary air; and wherein said at least one port is a port originally provided in said wall for installing an oil deslagging system.

7. The process of claim 6 wherein said means for discharging comprises a lance having a plurality of perforations.

8. The process of claim 6 wherein said means for discharging comprises a plurality of V-jet nozzles.

9. A process for limiting the amount of nitrogen oxides produced in the combustion flame zone of a cyclone boiler furnace having a combustor section, a furnace section, and a secondary air system, comprising the steps of:

conveying a liquid water cooling medium from a source of said liquid water cooling medium through at least one port contained within a wall located in a plenum chamber for secondary air of the cyclone boiler furnace to a means for discharging said cooling medium positioned within said plenum chamber at a position where a flow of secondary air has a substantially uniform velocity, said location being prior to the combustion flame zone, said conveying conducted through a series of pipes running from said source of liquid water cooling medium through said at least one port to said means for discharging.

discharging said liquid water cooling medium into the secondary air system where said cooling medium is mixed with said flow of secondary air; and wherein said at least one port is at least one port originally provided in said wall for installing of a secondary air calibration pressure tap.

10. The process of claim 9 wherein said at least one port is a plurality of ports originally provided in said wall for installing a secondary air calibration pressure tap.

11. The process of claim 10 wherein said series of pipes running from said source of liquid water cooling medium through said at least one port comprises a first series of pipes which splits into a plurality of second series of pipes, each of said first series of pipes running through one of said plurality of ports, and each of said second series of pipes running to said means for discharging.

12. The process of claim 11 wherein said means for discharging comprises a plurality of V-jet nozzles, at least one of said plurality of V-jet nozzles mounted at the end of each of said second series of pipes.

13. The process of claim 12 wherein said V-jet nozzles are oriented to spray water at an angle of between 20° and 160° with respect to an axis running along the center of each of said nozzles.

14. The process of claim 12 wherein said V-jet nozzles are located within the plenum section of the secondary air inlet duct in a plane interspatial to a plane of fuel introduction.

15. The process of claim 12 wherein said plurality of V-jets are deployed sequentially to increase the water injection rate in response to measurements of load, boiler excess air, and ambient temperature.

16. The process of claim 12 further comprising providing a control system for controlling said conveying.

17. The process of claim 16 wherein said control system conveys a quantity of water in proportion to the quantity of fuel fired, and at times when both oil and gas are mutually fired, the control system recognizes the two sources of fuel and calculates the necessary quantity of water to be injected.

18. The process of claim 12 wherein said plurality of V-jet nozzles is between about 2 and 20 V-jet nozzles.

19. The process of claim 18, further comprising the step of utilizing a cold-flow model to determine optimum locations for each of said between about 2 and 20 V-jet nozzles within said secondary air plenum chamber, said cold-flow model simulating the geometry and airflow characteristics of the cyclone combustion chamber.

20. The process of claim 19 wherein said V-jet nozzles inject water droplets sized to substantially completely evaporate within a bulk residence time calculated for the cyclone combustor section, such that substantially no droplets exit the cyclone section and substantially no droplets enter the furnace section.

21. The process of claim 20 wherein said V-jet nozzles are constructed to produce water droplets having a mean droplet diameter of less than about 200 microns.

22. A process for limiting the amount of nitrogen oxides produced in the combustion flame zone of a cyclone boiler furnace having a secondary air system, comprising the steps of:

conveying liquid water from a source of said liquid water through at least one port contained within a wall located in a plenum chamber for secondary air of the cyclone boiler furnace to a plurality of V-jet nozzles for discharging said liquid water positioned within said plenum chamber at a position where a flow of secondary air has a substantially uniform velocity, said location being prior to the combustion flame zone, said conveying being conducted through a series of pipes running from said source of water through said at least one port to said V-jet nozzles, said port being at least one port originally provided in said wall for installing at least one of the following: an oil deslagging system and a secondary air calibration tap;

discharging said liquid water into the secondary air system where said liquid water is mixed with said flow of secondary air such that substantially all of said water is vaporized into steam prior to exiting the cyclone and prior to contact with the combustion flame, vaporization of said water providing a total heat of vaporization sufficient to remove enough heat from the secondary air system to effectively limit the combustion temperature; and controlling the amount of water injected using a control system which utilizes measurements of process conditions.

23. An apparatus for limiting the amount of nitrogen oxides produced in the combustion flame zone of a cyclone boiler furnace having a secondary air system, comprising:

a source of liquid water;

a cyclone boiler furnace including a plenum chamber for secondary air having at least one port contained within a wall thereof, said port being at least one port originally provided in said wall for installing at least one of the following: an oil deslagging system and a secondary air calibration tap;

a means for discharging water positioned within said secondary air plenum chamber at a position where a flow of secondary air has a substantially uniform velocity, said location being prior to the combustion flame zone; and a means for conveying water from said source of liquid water to said means for discharging water;

a means for vaporizing substantially all of said water prior to contact with the combustion flame to provide a total heat of vaporization sufficient to lower the amount of heat in the secondary air to effectively limit the combustion temperature; and a control system which utilizes measurements of process conditions to continuously control the amount of water added.

* * * * *